US007055625B1

(12) United States Patent
Myrick et al.

(10) Patent No.: US 7,055,625 B1
(45) Date of Patent: Jun. 6, 2006

(54) SELF-PROPELLED INSTRUMENTED DEEP DRILLING SYSTEM

(75) Inventors: Thomas M. Myrick, Warren, NJ (US); Stephen Gorevan, New York, NY (US)

(73) Assignee: Honeybee Robotics, Ltd., New York, NY (US)

( * ) Notice: Subject to any disclaimer, the term of this patent is extended or adjusted under 35 U.S.C. 154(b) by 122 days.

(21) Appl. No.: 10/766,414

(22) Filed: Jan. 27, 2004

Related U.S. Application Data

(60) Provisional application No. 60/443,215, filed on Jan. 27, 2003.

(51) Int. Cl.
*E21B 44/00* (2006.01)

(52) U.S. Cl. ..... 175/26; 175/58; 175/76; 299/31

(58) Field of Classification Search ..... 175/51, 175/26, 27, 76, 95, 97, 58; 405/138; 299/1.3, 299/31, 58
See application file for complete search history.

(56) References Cited

U.S. PATENT DOCUMENTS

| | | | | | |
|---|---|---|---|---|---|
| 1,388,545 | A * | 8/1921 | Bohan | 175/19 |
| 1,639,215 | A * | 8/1927 | De Grassi | 299/56 |
| 2,946,578 | A * | 7/1960 | De Smaele | 299/1.3 |
| 3,123,157 | A * | 3/1964 | Graham | 175/58 |
| 3,345,108 | A * | 10/1967 | Newman et al. | 299/31 |
| 3,354,969 | A * | 11/1967 | Ebeling | 175/94 |
| 3,375,885 | A * | 4/1968 | Scott et al. | 175/26 |
| 3,767,263 | A * | 10/1973 | Gootee | 299/33 |
| 4,085,808 | A * | 4/1978 | Kling | 175/94 |
| 4,461,360 | A * | 7/1984 | Mount, II | 175/78 |
| 4,494,799 | A * | 1/1985 | Snyder | 299/31 |
| 4,700,788 | A * | 10/1987 | Langner | 175/61 |
| 5,758,731 | A * | 6/1998 | Zollinger | 175/99 |
| 6,427,786 | B1 * | 8/2002 | Beaufort et al. | 175/99 |
| 6,484,819 | B1 * | 11/2002 | Harrison | 175/61 |

* cited by examiner

*Primary Examiner*—David Bagnell
*Assistant Examiner*—Daniel P Stephenson
(74) *Attorney, Agent, or Firm*—Leighton K. Chong; Godbey Griffiths Reiss & Chong

(57) ABSTRACT

An autonomous subsurface drilling device has spaced-apart forward and rearward "feet" sections coupled to an axial thruster mechanism between them to operate using an inch-worm method of mobility. In one embodiment, forward and rearward drill sections are carried on forward and rearward "feet" sections for drilling into material in the borehole in both forward and rearward directions, to allow the device to maneuver in any direction underground. In another embodiment, a front drill section has a drill head for cutting into the borehole and conveying cuttings through a center spine tube to an on-board depository for the cuttings. The feet sections of the device employ a foot scroll drive unit to provide radial thrust and synchronous motion to the feet for gripping the borehole wall. The axial thrust mechanism has a tandem set of thrusters in which the second thruster is used to provide the thrust needed for drilling, but not walking. A steering mechanism composed of concentric inner and outer eccentric rings provided with the rearward feet section allow small corrections in both direction and magnitude to the drilling direction as drilling commences.

16 Claims, 9 Drawing Sheets

Opposition Configuration

Tandem Configuration

SELF-PROPELLED INSTRUMENTED DEEP DRILLING SYSTEM

This U.S. patent application claims the priority of U.S. Provisional Application No. 60/443,215 filed on Jan. 27, 2003, entitled "Inchworm Deep Drilling System", with inventors in common herewith.

The subject matter herein was developed in part under a research contract provided by the U.S. Government, National Aeronautics and Space Administration (NASA), Contract No. NAG5-12839. The U.S. Government retains certain rights in the invention.

TECHNICAL FIELD

This invention relates to a self-propelled drilling device which can autonomously drill deep holes while moving into the ground, in order to eliminate the need for the conventional type of drill-string drilling rig used in conventional deep drilling operations. The device is particularly desired for use in autonomous deep drilling applications such as for probes on extraterrestrial bodies, as well as for applications on Earth.

BACKGROUND OF INVENTION

In the prior art, there have been many types of drill platforms that are erected at the site of drilling and use a large number of drill strings (tubes) that are strung one after another to drill down deep into the soil or rock. This approach requires a substantial amount of mass and volume as well as power to perform deep drilling with a long string of drill tubes into the ground. In all cases where conventional drill rigs are used, a flushing mechanism is also required for the purpose of removing cuttings from the hole as well as for cooling and lubricating the drill bit far down in the hole.

The disadvantages of the prior art are many. The conventional drill platform requires a great deal of mass and packaging volume to accomplish its task. Typically, there is a degree of assembly or deployment involved as well as manpower to perform the drilling operations that adds to the overall complexity and therefore risk. They also must employ a flushing system, whether it is air or a liquid of some kind, for the removal of cuttings from the hole as well as for drill bit lubrication and cooling. This type of massive, high power, complex machinery and associated flushing system would be totally unacceptable for use as probes that have to be flown and landed on any extraterrestrial bodies. Moreover, the massive amounts of material that would have to be left behind would be a waste of resources and might contaminate the alien surroundings, thus compromising scientific objectives.

There have been recent proposals to use drilling devices that have autonomous mobility underground using the "inch-worm" type of locomotion in which a forward section drills forward into the ground while a rearward section contracts to the position of the forward section, then the rearward section plants itself in place while the forward section extends itself and drills further ahead. However, in the proposed devices cuttings from the unit are passed back up to the ground station through a vacuum-powered tether or umbilical tube. The tether is also used to supply electric power down to the unit. However, tether management for a subsurface probe that travels to depths below a kilometer may be an insurmountable engineering problem, especially in a planetary exploration setting.

SUMMARY OF INVENTION

It is therefore a principal object of the present invention to provide an autonomous subsurface drilling device that eliminates the problems posed by tethers or umbilical tubes used for passage of cuttings. It is a particular object of the invention that the autonomous deep drilling device requires only modest support hardware, and that it is configured to be small, robust in mobility, and energy self-sufficient.

In accordance with the present invention, an autonomous subsurface drilling device has spaced-apart forward and rearward "feet" sections that operate using an inchworm method of mobility with a drill head mounted on least the forward section of the device. In the inchworm walking method, the two feet sections alternately move forward by extending their feet radially to provide a secure grip on the borehole. An axial thrust mechanism is located between the two feet sections for the purpose of advancement during walking. The rearward feet section locks onto the borehole while the axial thrust mechanism is extended, thereby pushing the forward feet section and the drill bit set further down the mobility path. In turn, the forward feet section locks onto the borehole wall, while the rearward feet section unlocks from the borehole and moves forward with retraction of the axial thrust mechanism to a position ready for the next step of the inchworm mobility sequence. The device has an on-board depository for cuttings or core samples, so that they do not have to be passed to the surface through management of a tether tube while the device is in operation deep below the surface.

In one preferred embodiment, a pair of forward and rearward drill sections carried respectively on said forward and rearward "feet" sections for drilling into material in the borehole in both forward and rearward directions, whereby the device can maneuver in any direction underground. A science instrument section is provided to take samples from the borehole radially from the main axis of the device.

In another preferred embodiment, a front drill section has a drill head for cutting into the borehole and conveying cuttings through a center spine tube along the main axis of the device to an on-board depository for collecting the cuttings, so that cuttings do not have to be passed to the surface while the device is in operation deep below the surface. The feet sections of the device employ a foot scroll drive unit which spins about the longitudinal axis of the device in order to extend and provide radial thrust to the feet for gripping the borehole wall as well as providing coaxial alignment of the mechanism to the borehole. The axial thrust mechanism has a tandem set of thrusters in which the second thruster is used to provide the thrust needed for drilling, but not walking. The drilling thruster allows both feet sections to be locked onto the borehole wall while the drilling thruster is extended. Further, the forward feet section is placed as close to the drill head as possible so that a high level of drilling stiffness is insured.

In the latter preferred embodiment, the center spine tube is a main structural component of the device to which all elements of the drill are either directly fixed or on which they are supported through linear bushings. The drilling thruster, both drill bit motor drive plates and the cutting depository are directly attached to the spine whereas all other components are held to the spine via linear bushings. A dual system of drill bits is provided in which a small-diameter drill bit is fixed to an auger that is almost as long as the overall system and resides along the center axis of the system. A second, larger-diameter drill bit has a hole through the center in which the smaller drill bit is concentrically positioned. The larger drill bit has fluting along its outer diameter and bottom that is shaped in such a way so as to direct the cuttings to the center of the bit, and the smaller drill bit has a long fluted shaft shaped to convey the cuttings along the fluting through the center spine tube to the rear of the device where the cutting depository is located. The cuttings are then stored into the depository's interior volume without requiring external cutting removal. A steering mechanism composed of concentric inner and outer eccentric rings may be provided with the forward feet section to allow small corrections to the drilling direction as drilling commences.

Other objects, features, and advantages of the present invention will be explained in the following detailed description of the invention having reference to the appended drawings.

DETAILED DESCRIPTION OF INVENTION

Figure 1A:
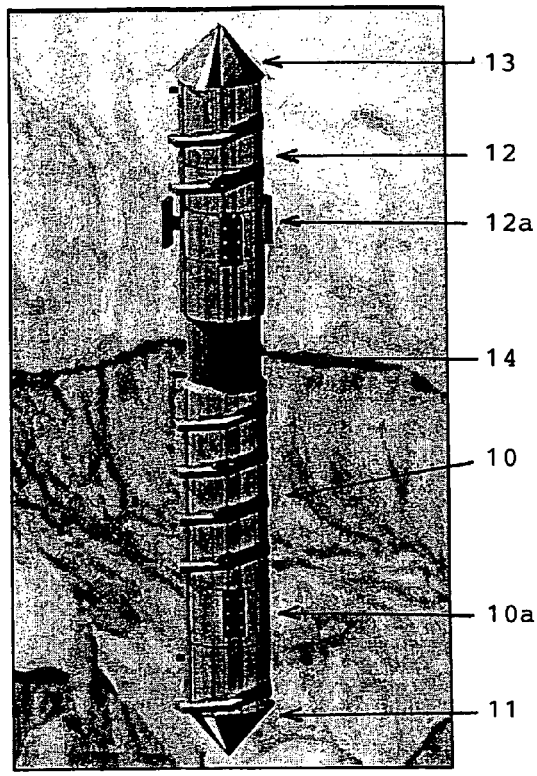
FIG. 1*a* shows a rendering of an autonomous subsurface drilling device in accordance with the present invention having an on-board power source and forward and rearward drill tips.

Referring to FIG. 1*a*, a first embodiment of an autonomous subsurface drilling device in accordance with the present invention has an on-board power source, and therefore does not require a power cord, and forward and rearward drill tips. A forward section 10 with extendable forward shoes 10*a* and descent drill tip 11 is spaced apart from a rearward section 12 with extendable aft shoes 12*a* and ascent drill tip 13. The two sections are connected by a thrust mechanism 14 which can expand and contract for the inchworm walking sequence. The figure shows the aft shoes of the rearward section in the extended position.

Figure 1B:
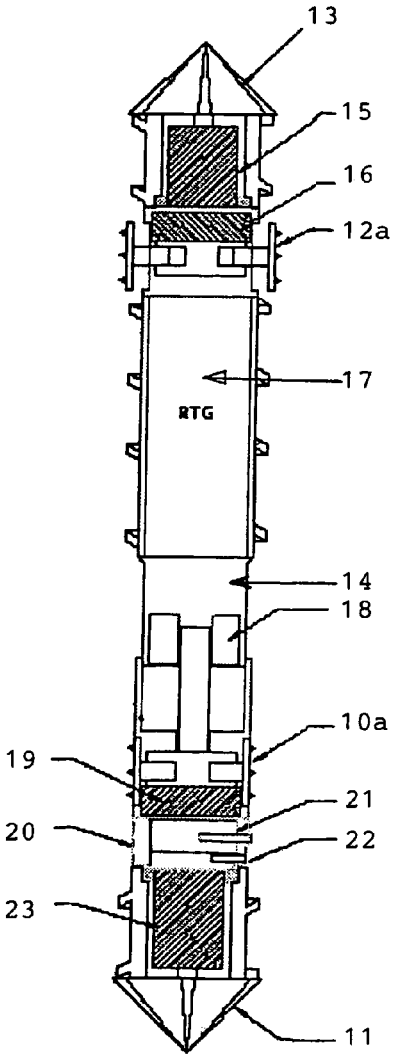
FIG. 1*b* is a schematic sectional view of the embodiment of the autonomous subsurface drilling device of FIG. 1*a*.

In FIG. 1*b*, the device is shown in a schematic sectional view having, in series from aft (rearward) to front (forward), ascent drill motor 15 for powering the ascent drill tip 13, aft shoe deploy motor 16 for powering the aft shoes 12*a*, an on-board power system 17, such as batteries, a fuel cell or a radioactive thermoelectric generator (RTG), linear actuator 18 for powering the thrust mechanism 14, forward shoes 10*a* powered by forward shoe deploy motor 19, a science instrument section 20 including a minicorer sampler 21 and a microscope 22, and descent drill motor 23 for powering the ascent drill tip 11. Spiral flutings or ribs on the outer walls of the ascent and descent drill heads can turn with these sections during a drilling sequence for the purpose of conveying drilling debris to the rear of the device. In this embodiment, the device is optimized for movement snaking through the underground in either forward or backward directions, and scientific samples are taken by the science instrument section 20 which can take a core sample by extending the minicorer sampler 21 or an image by extending the microscope 22 radially.

Figure 1C:
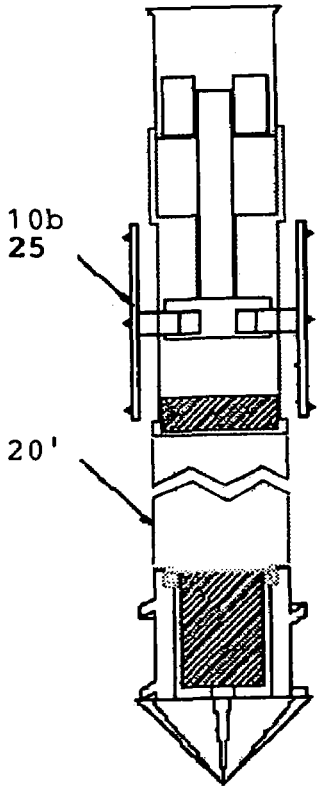
FIG. 1*c* is a schematic sectional view of another variation of the autonomous subsurface drilling device having large "snowshoes" for travel through soft material.

FIG. 1*c* illustrates a variation the autonomous subsurface drilling device having large "snowshoes" 10*b* for travel through soft material. The science payload section 20' may also be made larger.

Figure 1D:
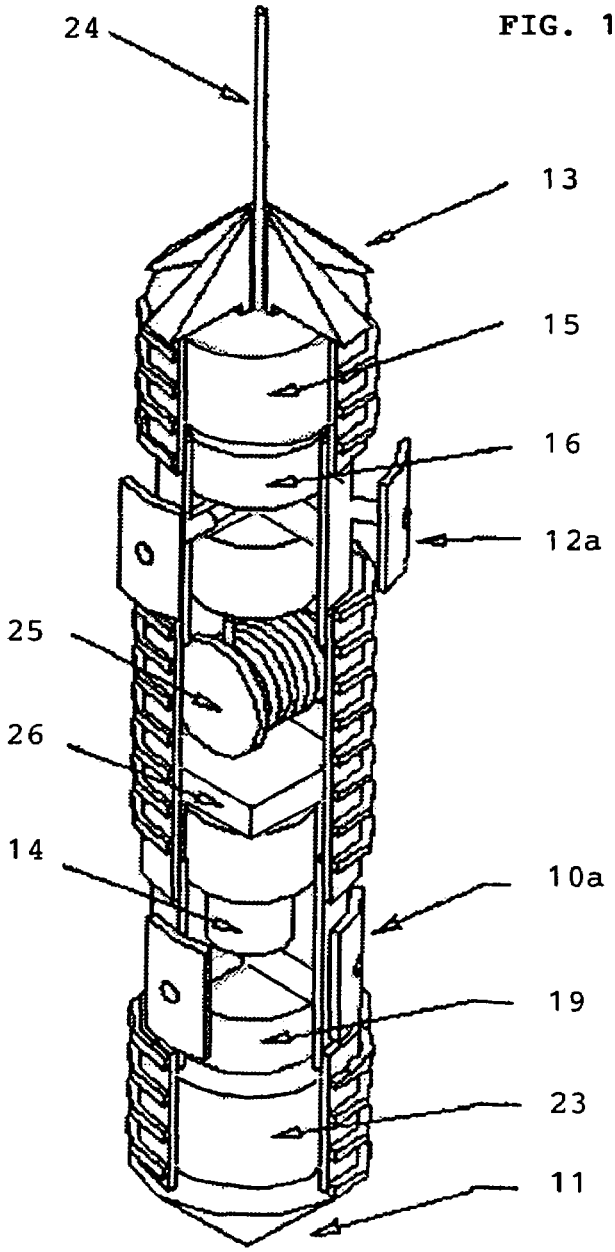
FIG. 1*d* is a perspective view of another embodiment of the autonomous subsurface drilling device using a power cable connected to an external power source.

In FIG. 1*d*, another variation of the above-described autonomous subsurface drilling device has a power cable 24 for connecting to an external power source, instead of an on-board power source. The power cable 24 extends from the device through a central aperture in the ascent drill tip 13. The cable is wound or unwound on reel 25 which is driven and tensioned by the reel motor controller 26. The use of external power saves weight and space on-board the device, but requires the electric cord tether to the ground station. Current tests indicate that a customized diamond drill head in the 10 to 15 centimeter range will be able to readily penetrate very strong rocks (up to and beyond 100 megapascals in compressive strength) and draw no more power than 500 to 1000 watts, which is within the capability of contemplated on-board power units. As a point of reference, Radioisotopic Thermoelectric Generators (RTGs) used on the Galileo probe were 40 centimeters in diameter when launched in 1990. Size reduction efforts to date indicate that an RTG diameter of about 10 centimeters can be achieved. However, until compact miniaturization is achieved, the drilling device can be designed to use external power on an electric cord tether.

Figure 2:
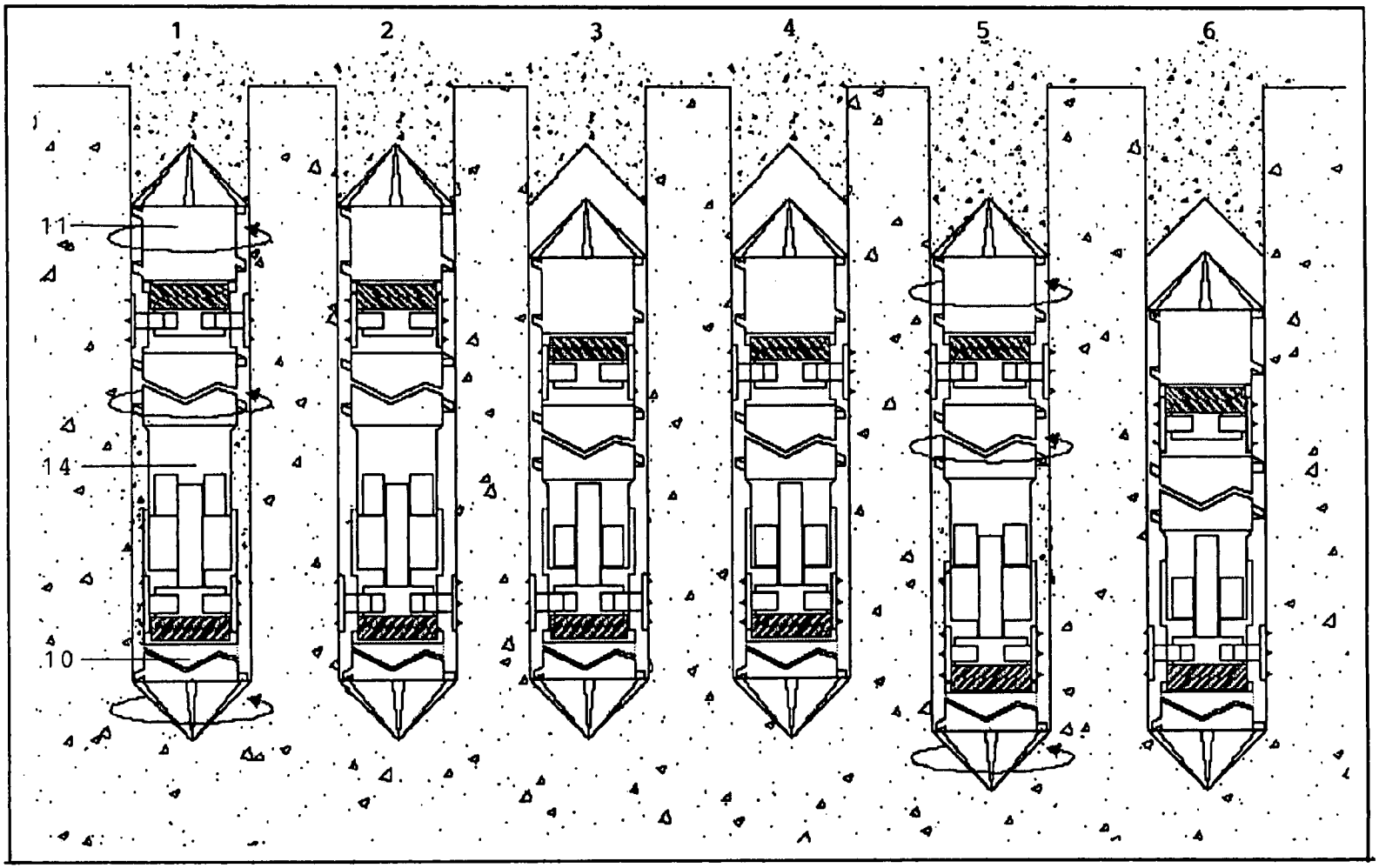
FIG. 2 illustrates the inchworm locomotion sequence of the autonomous subsurface drilling device.

FIG. 2 illustrates the inchworm locomotion sequence of the autonomous subsurface drilling device. In Stage 1, the aft shoes are extended from the rearward section 11 to secure the device to the borehole wall. The forward section 10 is thrust forward from the rearward section 11 via the thrust mechanism 14 powered by its linear actuator. This provides thrust for the forward end which carries the forward drilling head. The ascent and descent drill heads are both rotated, and the spiral ribs on the outer walls of these sections convey the drilling debris to the rear of the device. The thrust and drilling torque are reacted through the shoes and absorbed into the borehole wall. In Stage 2, when the thrust mechanism has extended as far as it can go, the shoes of the forward section 10 are extended to make secure contact with the borehole wall. Then, the shoes of the rearward section 11 are retracted, in Stage 3, and the thrust mechanism pulls the rearward section forward toward the front half of the device. In Stage 4, the aft shoes are again extended to grip the borehole wall. Again, in Stage 5, the ascent and descent drill heads are both rotated, and the spiral ribs convey the drilling debris to the rear of the device, resulting in advancement of the forward section and filling of the vacated space to the rear of the device with debris. In Stage 6, the rearward section is again inched forward.

The inchworm method of walking is independent of gravity and allows for the device to drill back up to the surface if necessary. Should the borehole wall be composed of very soft or unconsolidated material, the feet of the device can be made large like a "snowshoe" for stability.

Figure 3B:
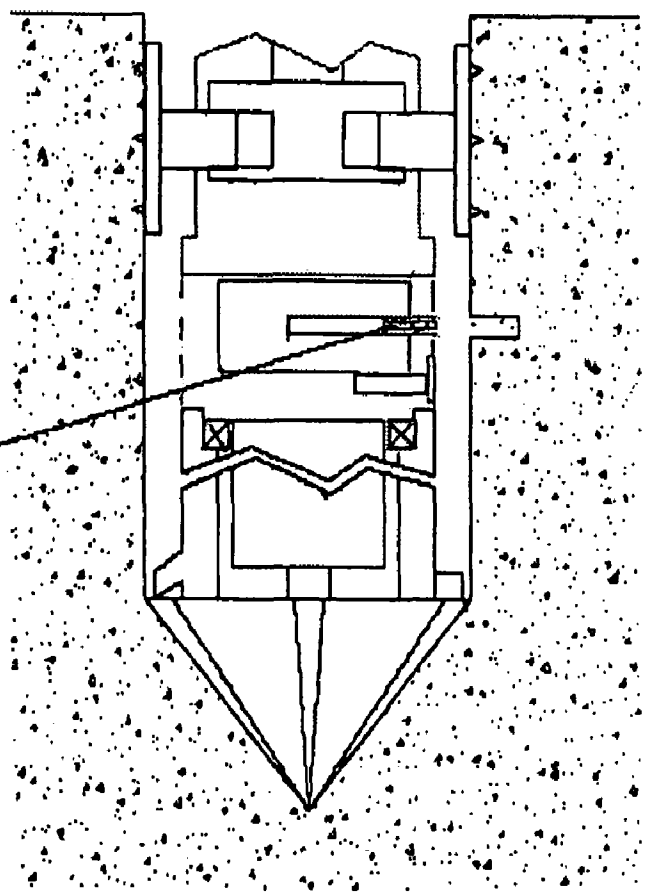
FIGS. 3*a* and 3*b* illustrate a radial sample acquisition sequence of the autonomous subsurface drilling device.
Figure 3A:
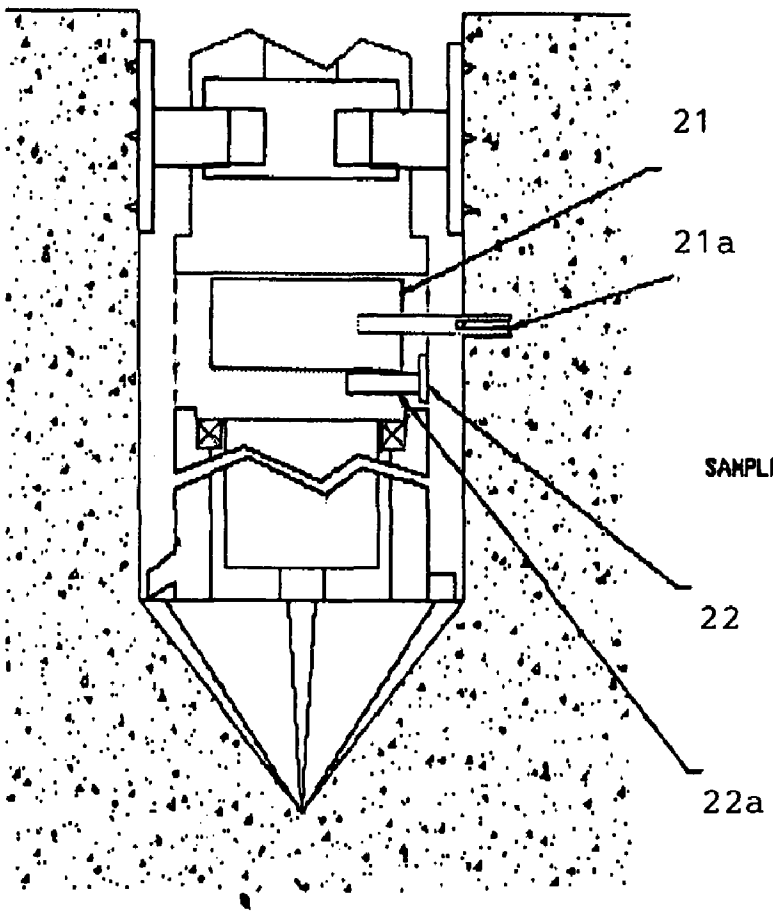

FIGS. 3*a* and 3*b* illustrate a radial sample acquisition sequence of the autonomous subsurface drilling device. The minicorer sample acquisition system 21 is situated in the device between the forward and rearward feet sections and can take a sample from the borehole walls at points along the extension length of the thrust mechanism. The coring tip extends radially from the device and retrieves a sample core into the device housing. An oven that supports a Gas Chromatograph Mass Spectrometer investigation may also be provided. Other science tools may be positioned in the science instrument section, such as an optical window 22 in the device wall and a microscope 22*a*. The optical microscope may used to allow for direct view of the borehole walls or drill cuttings thereby eliminating the need for complicated sample manipulation.

Figure 4:
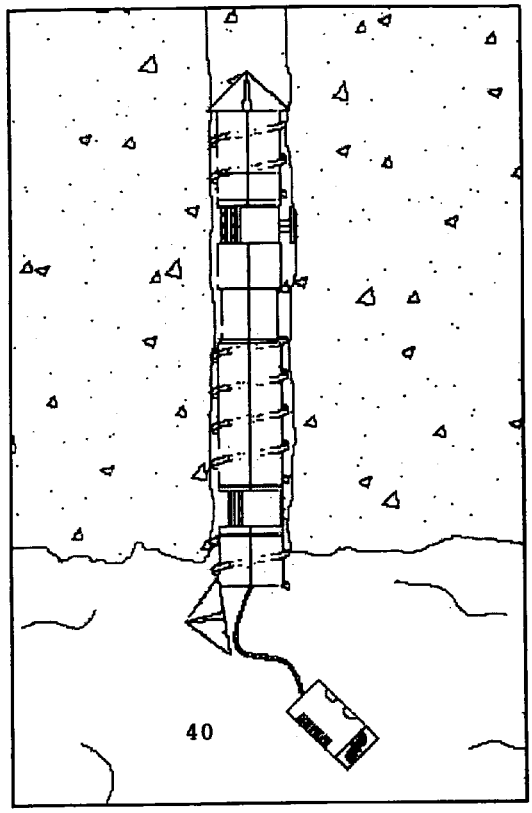
FIG. 4 illustrates in-hole instrument deployment from the autonomous subsurface drilling device.

FIG. 4 illustrates in-hole instrument deployment from the autonomous subsurface drilling device. The device can be equipped with various instruments that can be brought down the borehole, such as a miniature submersible sensor package 40 that could be deployed in a ground water or other fluid channel when the device drills down to that depth, as shown in the figure. In all cases for in situ instrumentation, data can be recorded and downlinked to Earth when the device reaches the surface or data could be passed along miniature communication buoys left along the drilling route.

Figure 5:
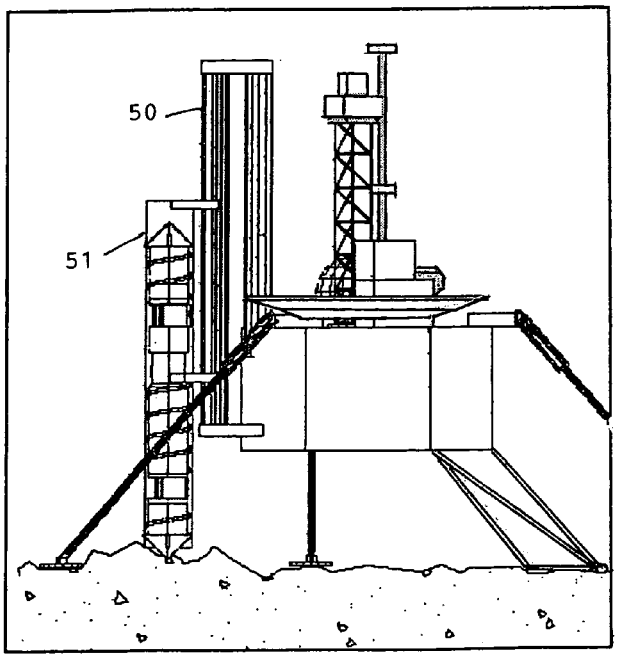
FIG. 5 illustrates deployment of the autonomous subsurface drilling device from a probe lander on a planetary body.

FIG. 5 illustrates deployment of the autonomous subsurface drilling device from a probe lander on a planetary body. A support frame 50 may be used to position a launch tube 51 carrying the device over the desired entry position on the ground. The first meter or so of material could is expected to be soft enough to allow deployment of the device. For the initial drilling, the device reacts the necessary drilling torque into slotted holding surfaces of the launch tube while thrust loading is provided by the weight of the device in the local gravity. This allows drilling into the ground for the first meter or until the device has descended to a region where the ground material allows for shoe deployment and its nominal torque and thrust reaction function.

Figure 6:
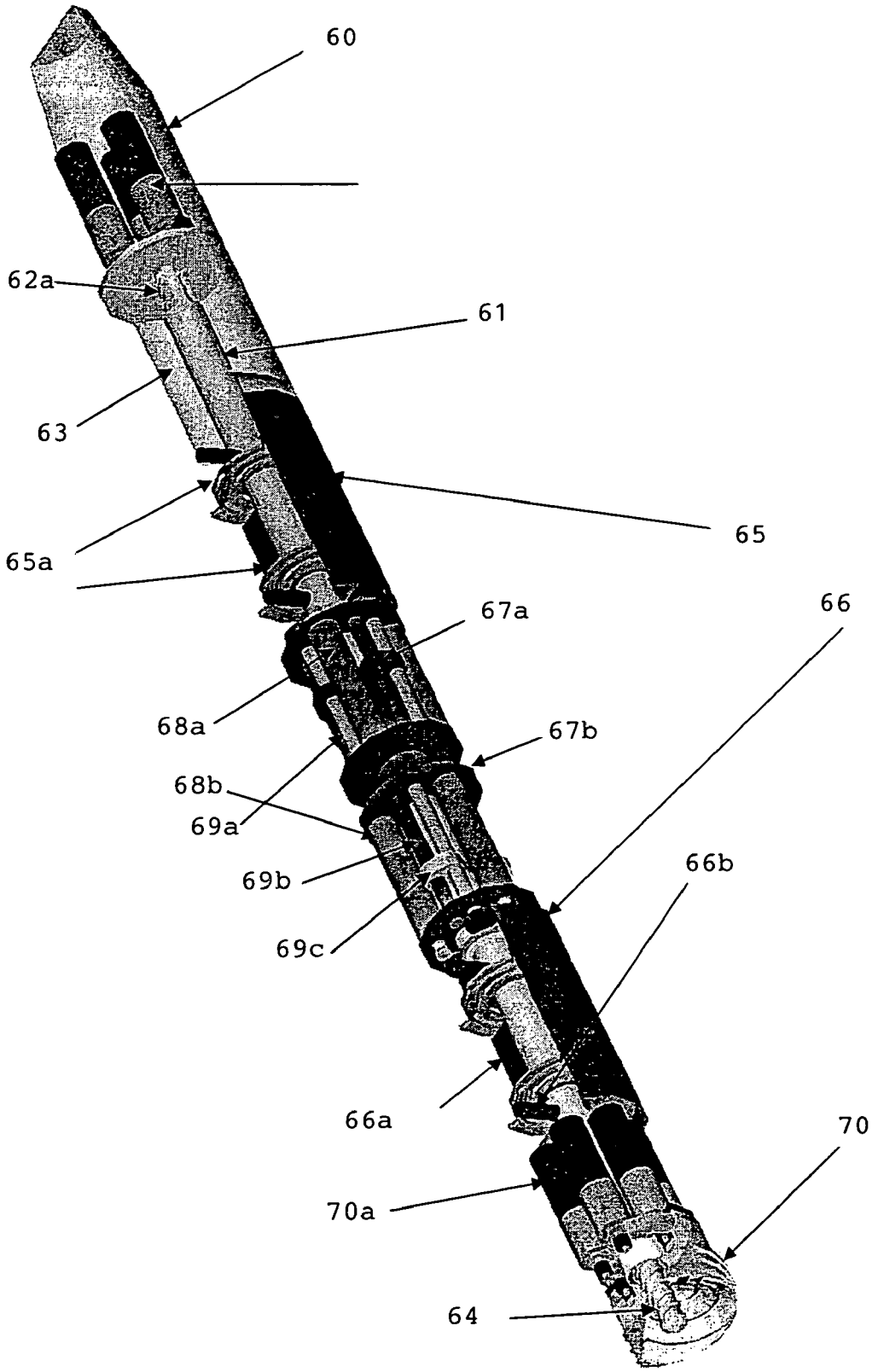
FIG. 6 is a perspective view of another embodiment of the autonomous subsurface drilling device having forward and rearward feet sections that use radial foot scroll drive units.

FIG. 6 is a perspective view of another embodiment of the autonomous subsurface drilling device having forward and rearward feet sections characterized by use of radial foot scroll drive units. This embodiment of the device has an elongated housing 60 with a hollow central spine tube 61 running down its length from rear to front to provide lateral structural support. At the rear part of the housing are the motor drives 62 which rotate a fluted shaft 62*a* that drive a center drill bit 64. The center drill bit 64 is concentrically arranged within the main drill head 70. The main drill head 70 has flutings on its interior face for conveying the cuttings toward the center drill bit 64 where they are conveyed by the fluting on the surface of the central drill shaft through the central spine tube 61 to the cutting's depository bin 63. The rear feet section has radially extended feet 65 which are deployed outward by a unique scroll drive 65*a* which spin on the central axis and unwind to provide radial thrust to and synchronous movement of the feet 65. Similarly, the front feet section has feet 66 which are deployed outward by the scroll drive 66*a* by moving along the radial feet guides 66*b*. Tandem thruster sets 67*a* and 67*b* are configured to allow one set of thrusters to move relative to the other set. The motor drives for the thrusters are indicated at 68*a* and 68*b*. The leadscrews and guide shafts for the respective thruster sets (3 pairs per thruster) are indicated at 69*a* and 69*b*. A flange 69*c* holds the leadscrews to the central spine of the device to allow both sets of thrusters to move axially relative to the drillhead.

The concentric drill bits within the device operate as follows. The small diameter, center drill bit 64 is fixed to an auger shaft that is almost as long as the whole system and resides along the center of the system. The main, larger diameter drill bit 70 has a hole through the center that is the same size as the cutting diameter of the smaller drill bit. The larger drill bit has fluting along its outer diameter and bottom that is shaped in such a way so as to direct the cuttings to the center of the bit rather than toward the outer wall as is typical with all conventional drilling devices. The smaller drill bit with its long fluted shaft is shaped in the conventional way so as to lift the cuttings it generates as well as the cuttings generated by the larger drill bit up along the fluting to the rear of the device where they are stored in the depository bin 63.

Other improvements may be provided in the use of two coaxial drill bits. The drill bits are driven independently of each other, and therefore may be rotated in the same or opposite direction. When rotating in opposite directions, the torque induced on the entire device is reduced by the difference between each drill bits' torque reaction, rather than the sum of each bits' torque reaction. Since the difference in cutting diameters of each of the drill bits is significant, this system allows for the smaller drill bit to rotate at a different (higher) rotational velocity than the larger drill bit, thus minimizing vibration and heat generation which will improve the overall cutting efficiency. The internal fluting in the opening of the main, larger-diameter bit is shaped to convey the cuttings toward the center of the drill where they are collected and conveyed by the fluting on the shaft of the inner drill bit to the depository bin.

Figure 7:
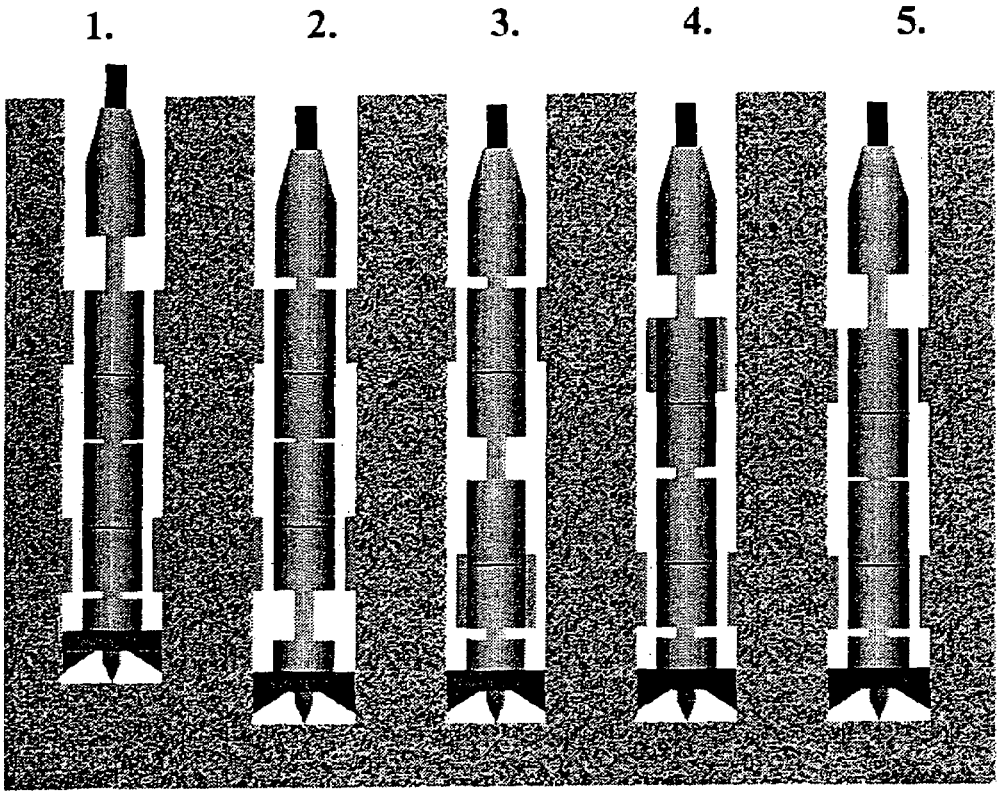
FIG. 7 illustrates the inchworm walking sequence of the embodiment of the autonomous subsurface drilling device in FIG. 6.

The device uses the inchworm method of mobility with the set of drill bits mounted on the front of the device. Referring to FIG. 7, in Stage 1 of the inchworm walking method, the two sets of rear and front feet are extended radially outward for providing a secure grip within the borehole for the thrust reaction of the drill bit advancement to be accommodated. In Stage 2, the second of the tandem thrusters advances the drill head drilling forward into the borehole. In Stage 3, the rearward set of feet remain locked onto the borehole while the forward feet are retracted and the first of the tandem thrusters will extend and push the forward set of feet and drill bits further down the mobility path. In Stage 4, the forward set of feet lock onto the borehole wall, while the rearward set of feet are retracted from the borehole, and the axial thrust mechanism is retract to move the rear section further down the borehole. In Stage 5, both the rear and forward sets of feet are locked onto the borehole wall, thus completing one step of the inchworm mobility sequence. The mechanical setup allows for the forward set of feet to be placed as close to the drill head as possible so that a high level of drilling stiffness is insured.

Figure 8:
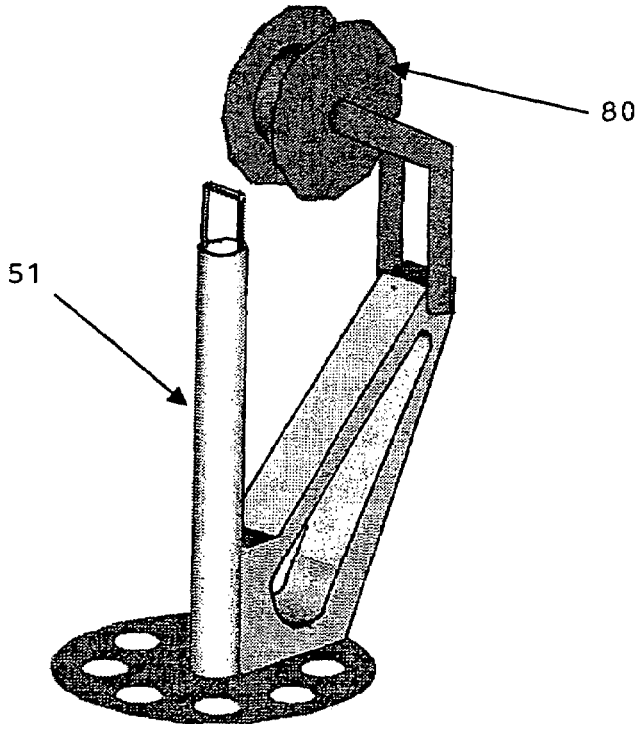
FIG. 8 illustrates deployment of the autonomous subsurface drilling device through a launch tube using a tether wheel for playing out and reeling in an electrical power cord for the device.

The central spine 61 is the main structural component of the device. All elements of the drill are either directly fixed to the spine or are supported by the spine through linear bushings. The drilling thruster, both drill bit motor drive plates and the bucket are directly attached to the spine whereas all other components are held to the spine via linear bushings. Power can be provided to the device in either of two preferred ways. As shown in FIG. 8, the first method is to incorporate a tether spun onto a reel 80 mounted to the top of the launch tube 51 that will provide power, data transmission and a structural link to the device. The second method is to use Radioactive Thermo-electric Generators (RTG) mounted within the device as a means of onboard power generation, as shown for the previous embodiment. Future RTG's are expected to have the efficiency and small packaging volume for use in such a system. Heat rejection within the RTG needs to be addressed within the design of the device at such a time as well.

At a point where the depository bin is full of cuttings, the device can walk back up the borehole wall all the way to the surface and up the launch tube until the bin fully extends above the top of the launch tube. At this point, the bin opens and ejects the cuttings along the outside of the launch tube and onto a collecting surface. The length of the launch tube is sufficient to allow for a great deal of cuttings to be ejected and deposited onto the collecting surface without the risk of having the cuttings envelope the launch tube and fall back into the borehole. In the case where a tether is used to provide power to the device, the tether can be used to winch the drill up and down the borehole much more quickly than the device can walk, thereby increasing the overall penetration rate of the system dramatically especially as the depth increases. In the event the device becomes stuck either on its way up or down the borehole, the walking capability of the system can be employed to navigate beyond the stuck region and proceed up or down the hole.

Figure 9A:
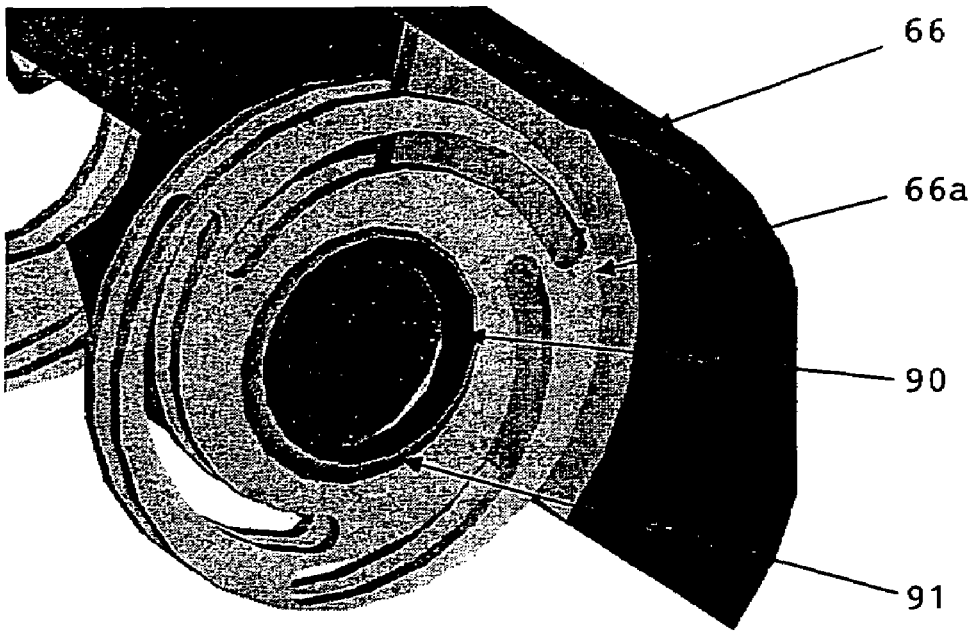
FIGS. 9*a* and 9*b* illustrate a steering system for steering the autonomous subsurface drilling device in alignment with a desired direction for the borehole.
Figure 9B:
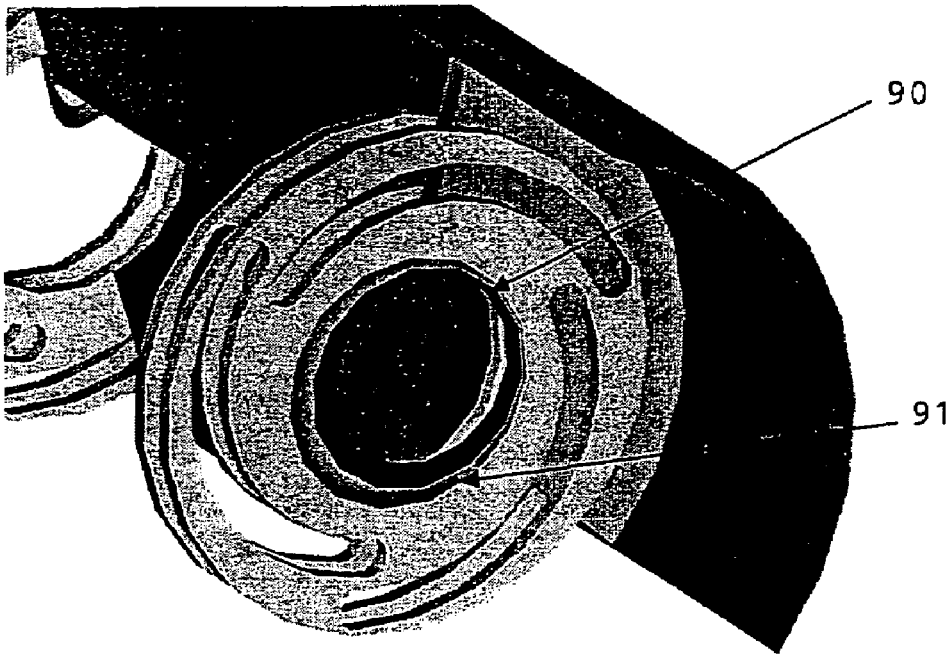
Figure 10A:
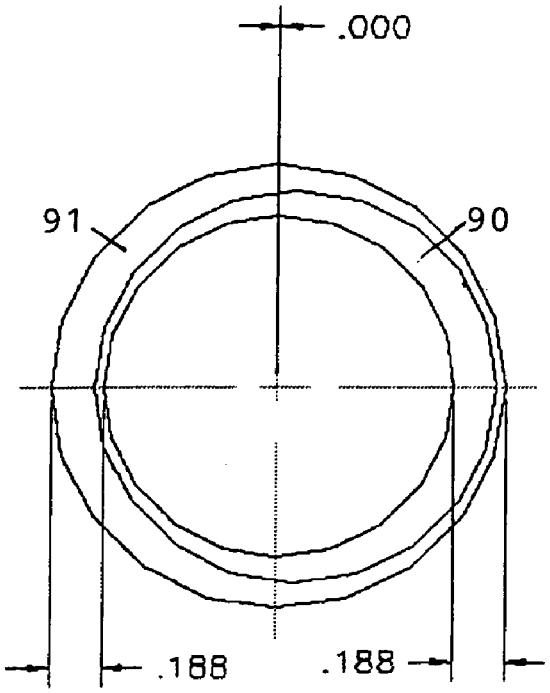
FIGS. 10*a* and 10*b* are schematic diagrams showing an opposition configuration compared to a tandem configuration for the eccentric ring components of the steering system.
Figure 10B:
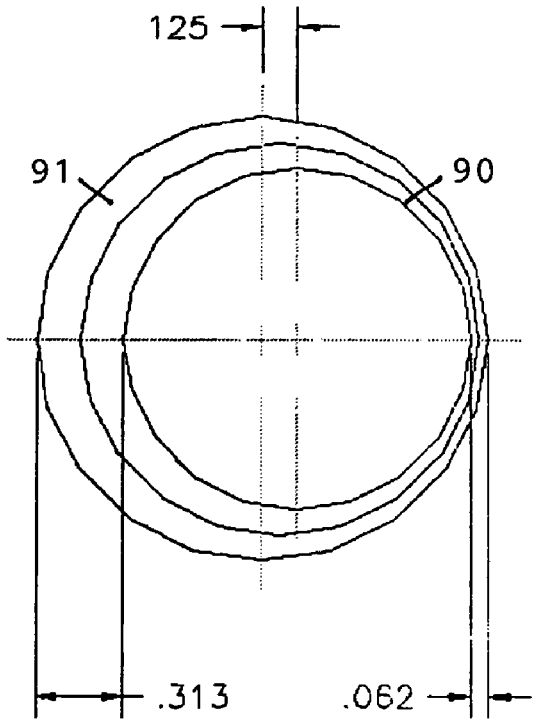

An additional feature that can be used with the system is a steering mechanism that will enable the drill to make small adjustments to the drilling direction in order to insure the drill proceeds along a desired path aligned with the planned drill path or with a chosen reference path such as parallel to the local gravity vector. A preferred embodiment of a steering mechanism is shown in FIGS. 9*a* and 9*b*. The steering mechanism is fitted to the scroll drive 66*a* for the rearward feet 66. It consists of an inner eccentric ring 90 housed between an outer eccentric ring 91 and the central spine tube 61 of the device. These two rings each have a circular cutout in them that is a small amount, such as 1/16 of an inch, off center. As shown in FIGS. 10*a* and 10*b*, when mated and these eccentric cutouts are placed in opposition, the center of the inner eccentric ring 90 is lined up properly with the center line of the device. However, when the two eccentric cutouts are rotated so that they are in tandem, then the centerline of the steering system will be 1/8 of an inch off the centerline of the device, thus allowing the device to make a 1/8 inch correction in the forward drilling direction. This steering mechanism provides small directional adjustments to the drilling direction and magnitude.

Other enhancements that may be desirable include the ability to change drill bits while the device is within the launch tube. Various science instruments can be added to the system. For example, a coring device can be embedded within the smaller drill bit and auger for the purpose of collecting core samples at any depth for scientific study. Other science instruments can be located within a designated section of the device that could include temperature sensors, vibration detectors or virtually any kind of detector deemed necessary that can fit within a reasonably small envelope.

In summary, the device of the present invention provides notable advantages over the prior art. By using the inchworm mobility method in an autonomous drilling device, the conventional large surface rig and drill strings can be avoided. This saves an enormous amount of mass and volume, especially for extraterrestrial applications. Additionally, once the drill has penetrated into the ground so that at least the forward set of feet are capable of locking onto the borehole wall, no force or torque reaction is imposed on the launch tube or lander. This is a tremendous benefit to the design requirements of the spacecraft. Furthermore, there is no frictional increase as a function of depth with such an approach as the dynamics of drilling do not change with depth. In other words, the drilling characteristics will remain the same at say 100-meter depth as it would at the first meter of depth. This drilling system is also well suited for the addition of on board scientific instrumentation without the need for major changes to the drill design as all needed power and data storage/transmission are already incorporated in the design.

Another improvement feature in the invention is the incorporation of tandem axial thrusters: the first designed for high thrust generation needed for drilling, while the second thruster is designed to provide high speed, low thrust for use in walking. The use of tandem thrusters allows both sets of feet to be locked onto the borehole while the drill head is advanced into the rock. This provides a much more secure grip on the borehole and additional stiffness. Since the forward set of feet can lock onto the borehole while drilling, the steering mechanism allows the drill direction to be corrected while the feet are locked to insure that drilling commences along the desired path. This steering mechanism allows the system to continually monitor the path of the drill and to make small corrections in both direction and magnitude as drilling commences.

Regardless of what depth the device is drilling at, the length for conveying the cuttings into storage is the same, short traverse to the depository bin, thereby reducing the possibility of the transport system clogging or an increase in torque diminution caused by friction between the fluting and cuttings within the confines of the borehole, as would be the conventional case if the cuttings are transported to the surface via fluting in a long tether up the entire depth of the hole. Additionally, the cuttings are transported by fluted contained within the inner diameter of the spine, which is a smooth steel tube rather than a relatively rough rock borehole that will further enhance the ease in which the cuttings are transported.

A variety of scientific instruments can be added to the device with little to no changes required of the drill. As the system already has provisions for power and data, all that would be required for a suite of instrumentation is some additional volume. This can easily be accommodated with a length extension either near the locking feet or in the electronics housing. Because the device has the ability to grip the borehole wall with a great deal of force (hundreds to thousands of pounds), both thermal and seismology sensors would benefit well from the intimate contact that can be made between such foot mounted sensors and the borehole wall. Microscopic imagers can be placed within the body of the device and have a consistent focal distance to the borehole wall because of the way the feet and body are mechanically arranged.

While certain embodiments and improvements have been described above, it is understood that many other modifications and variations thereto may be devised given the above description of the principles of the invention. It is intended that all such modifications and variations be considered as within the spirit and scope of this invention, as defined in the following claims.

The invention claimed is:

1. An autonomous subsurface drilling device for drilling in a borehole comprising:

(a) a pair of spaced-apart forward and rearward feet sections coupled by an axial thruster mechanism between them that can expand and contract along a main axis of the device to allow the feet sections to grip the borehole wall and alternately move the forward feet section forward and pull up the rearward feet section using an inchworm method of mobility;

(b) at least a front drill section having a drill head for cutting into the borehole and conveying cuttings along the main axis of the device to an on-board depository for collecting the cuttings, so that cuttings do not have to be passed to the surface while the device is in operation deep below the surface, wherein said feet sections of the device each employs a scroll drive unit which spins about the axis of the device in order to extend and provide radial thrust to the feet for gripping the borehole wall.

2. An autonomous subsurface drilling device according to claim 1, wherein said axial thruster mechanism is composed of tandem sets of thrusters, one of said thruster sets being used to advance the front drill section, and the other thruster set being used to advance the forward feet and to contract the rearward feet section forward.

3. An autonomous subsurface drilling device according to claim 2, wherein said tandem sets of thrusters allow both feet sections to be locked onto the borehole wall while the front drill section is being extended for drilling.

4. An autonomous subsurface drilling device according to claim 1, further comprising a central spine tube to which all elements of the drill are either directly fixed or on which they are supported through linear bushings.

5. An autonomous subsurface drilling device according to claim 4, wherein said central spine tube is arranged to convey cuttings from the front drill section to a cutting depository bin located in a rearward section of the device.

6. An autonomous subsurface drilling device according to claim 4, further comprising a steering mechanism provided with said rearward feet section to allow small corrections to the drilling direction to be made as drilling commences.

7. An autonomous subsurface drilling device according to claim 6, wherein said steering mechanism is composed of an inner eccentric ring rotatable relative to an outer eccentric ring, said inner eccentric ring being rotatably coupled between said outer eccentric ring and said central spine tube, such that when said rings are rotated in opposition, said central spine tube is aligned with the direction of said rearward feet section, and when said rings are rotated in tandem, said central spine tube is aligned with a small eccentric correction from the direction of said rearward feet section.

8. An autonomous subsurface drilling device according to claim 1, wherein power is supplied to said device through a power cord tether connected to a supply source on the ground surface.

9. An autonomous subsurface drilling device according to claim 8, wherein a tether reel is provided on the ground surface to reel the tether in and out to said device.

10. An autonomous subsurface drilling device according to claim 1, wherein power is supplied to said device by a power unit carried onboard with the device.

11. An autonomous subsurface drilling device for drilling in a borehole comprising:

(a) a pair of spaced-apart forward and rearward feet sections coupled by an axial thruster mechanism between them that can expand and contract along a main axis of the device to allow the feet sections to grip the borehole wall and alternately move the forward feet section forward and pull up the rearward feet section using an inchworm method of mobility;

(b) at least a front drill section having a drill head for cutting into the borehole and conveying cuttings along the main axis of the device to an on-board depository for collecting the cuttings, so that cuttings do not have to be passed to the surface while the device is in operation deep below the surface; and (c) a central spine tube to which all elements of the drill are either directly fixed or on which they are supported through linear bushings, wherein said central spine tube is arranged to convey cuttings from the front drill section to a cutting depository bin located in a rearward section of the device, and wherein said front drill section is comprised of a main, larger-diameter drill head and an inner, smaller-diameter drill head positioned coaxially within a center opening of the main drill head, wherein said inner drill head is driven by an auger shaft disposed within said central spine tube extending lengthwise along the axis of said device from said front drill section to said depository bin, and wherein cuttings from said main drill head are conveyed toward said auger shaft of said inner drill head and conveyed through said central spine tube to said cutting depository bin.

12. An autonomous subsurface drilling device according to claim 11, wherein said coaxial drill heads are driven by respective drives independently of each other.

13. An autonomous subsurface drilling device according to claim 12, wherein said coaxial drill heads are driven in opposite rotational directions, so that torque induced on said device is reduced by the difference between each drill head's torque reaction.

14. An autonomous subsurface drilling device according to claim 12, wherein said coaxial drill heads are driven to rotate at different rotational velocities, in order to minimize vibration and heat generation.

15. An autonomous subsurface drilling device according to claim 11, wherein said auger shaft of said inner drill head has a spiral fluting on its external surface for conveying cuttings through the spine tube, and said main drill head has an internal fluting in its surfaces around its center opening which is shaped to convey cuttings from said drill head toward the center of said drill head where they are collected and conveyed by the fluting on the auger shaft of said inner drill head to said depository bin.

16. An autonomous subsurface drilling device for drilling in a borehole comprising:

(a) a pair of spaced-apart forward and rearward feet sections coupled by an axial thruster mechanism between them that can expand and contract along a main axis of the device to allow the feet sections to grip the borehole wall and alternately move the forward feet section forward and pull up the rearward feet section using an inchworm method of mobility;

(b) at least a front drill section having a drill head for cutting into the borehole and conveying cuttings along the main axis of the device to an on-board depository for collecting the cuttings, so that cuttings do not have to be passed to the surface while the device is in operation deep below the surface; and (c) a science instrument section carried onboard said device, wherein said science instrument section includes a submersible sensor package on a tether for sampling underground water or fluid.

* * * * *